US008745824B2

(12) United States Patent
Holstensson

(10) Patent No.: US 8,745,824 B2
(45) Date of Patent: Jun. 10, 2014

(54) HINGE DEVICE HAVING CONNECTED TUBULAR HOUSINGS

(75) Inventor: Lars Holstensson, Växjö (SE)

(73) Assignee: Holstensson Design AB, Vaxjo (SE)

( * ) Notice: Subject to any disclaimer, the term of this patent is extended or adjusted under 35 U.S.C. 154(b) by 37 days.

(21) Appl. No.: 13/381,059

(22) PCT Filed: Mar. 11, 2010

(86) PCT No.: PCT/SE2010/050274

§ 371 (c)(1),
(2), (4) Date: Mar. 2, 2012

(87) PCT Pub. No.: WO2011/002387

PCT Pub. Date: Jan. 6, 2011

(65) Prior Publication Data

US 2012/0151716 A1 Jun. 21, 2012

(30) Foreign Application Priority Data

Jul. 1, 2009 (SE) ..... 0900898

(51) Int. Cl.
*E05D 11/06* (2006.01)
*E05D 7/00* (2006.01)

(52) U.S. Cl.
USPC ..... 16/371; 16/366; 16/224; 16/257; 16/259

(58) Field of Classification Search
USPC ..... 16/366, 257, 259, 254, 260, 280, 282, 16/283, 284, 285, 302, 371, 224, 233; 403/322.2, 325
See application file for complete search history.

(56) References Cited

U.S. PATENT DOCUMENTS 277,925 A * 5/1883 Pfauntz ..... 16/366
1,003,618 A * 9/1911 Laski ..... 16/275

(Continued)

FOREIGN PATENT DOCUMENTS

CN 2469129 Y 1/2002
DE 2350304 A1 4/1975

(Continued)

OTHER PUBLICATIONS

International Search Report, 2010.

(Continued)

*Primary Examiner* — Emily Morgan
(74) *Attorney, Agent, or Firm* — Harness, Dickey & Pierce, P.L.C.

(57) ABSTRACT

A hinge device has a first part and a second part, which are intended to be attached to a door frame and a door, respectively. The first part and the second part are rigidly connected to each other and have each a tubular housing, whose center axis defines a first hinge axis and which accommodates two balls, an axially displaceable locking member arranged axially inwardly of each ball, a compression spring arranged between and cooperating with each ball and the associated locking member, and an eccentric located between the two locking members and cooperating therewith. Each eccentric is rotatably carried about a transverse axis in the respective housing and rotatable between an initial position, in which the two associated locking members are located in an axially inner position and the two associated balls are located in a position slightly projecting from the housing, in which position they are held biased by the respective compression spring, and an active position, in which the two associated locking members are located in an axially outer position, in which they abut against the respective ball axially locking it in the projecting position.

13 Claims, 5 Drawing Sheets

(56) References Cited

U.S. PATENT DOCUMENTS

| | | | | | |
|---|---|---|---|---|---|
| 1,217,607 | A | * | 2/1917 | Karl | 16/275 |
| 2,369,148 | A | * | 2/1945 | Langhorst | 16/229 |
| 3,671,998 | A | * | 6/1972 | Ruiz | 16/229 |
| 3,908,224 | A | * | 9/1975 | Vitt | 16/332 |
| 4,194,265 | A | * | 3/1980 | Zimmermann | 16/82 |
| 4,772,054 | A | * | 9/1988 | Schreiber et al. | 292/275 |
| 5,374,055 | A | * | 12/1994 | Tung | 473/485 |
| 5,659,929 | A | * | 8/1997 | Cheng | 16/366 |
| 5,685,046 | A | * | 11/1997 | Neag et al. | 16/366 |
| 5,940,934 | A | * | 8/1999 | Turner | 16/257 |
| 5,956,398 | A | * | 9/1999 | Weadon et al. | 379/433.05 |
| 6,151,754 | A | * | 11/2000 | Chen | 16/85 |
| 6,256,839 | B1 | * | 7/2001 | Wu | 16/366 |
| 6,584,642 | B2 | * | 7/2003 | Hodson | 16/85 |
| 6,994,393 | B2 | * | 2/2006 | Votruba et al. | 296/100.06 |
| 7,111,360 | B1 | * | 9/2006 | Hsu | 16/85 |
| 7,264,284 | B2 | * | 9/2007 | Hsu | 292/252 |
| 7,908,711 | B2 | * | 3/2011 | Johnson | 16/366 |
| 2004/0020011 | A1 | * | 2/2004 | Fang | 16/302 |
| 2007/0050948 | A1 | * | 3/2007 | Palmer | 16/422 |

FOREIGN PATENT DOCUMENTS

| | | | |
|---|---|---|---|
| DE | 8622214 | U1 | 5/1988 |
| FR | 2883902 | A1 | 10/2006 |
| IT | 1237603 | B | 10/1989 |
| JP | 2007332637 | A | 12/2007 |

OTHER PUBLICATIONS

European examination report dated Feb. 12, 2014 for corresponding European Application No. EP 10 79 4444.

* cited by examiner

HINGE DEVICE HAVING CONNECTED TUBULAR HOUSINGS

TECHNICAL FIELD

The present invention relates to a hinge device intended to be mounted on a first element, such as a door frame, and on a second element, such as a door, to enable pivoting of the two elements relative to each other, the hinge device having a first part, which is to be attached to the first element, and a second part, which is intended to be attached to the second element.

BACKGROUND ART

Various designs of hinge devices of this kind are known in the art. In prior-art hinge devices, the two parts are generally provided in the form of separate parts, which upon use of the hinge device become articulatedly interconnected or which have previously been articulatedly interconnected by means of a hinge pin and a hinge sleeve, which form a pivot located between the mutually pivotable elements, such as a door panel and a door frame, about which said elements are pivotable.

SUMMARY OF THE INVENTION

The object of the present invention is to provide a hinge device which, when mounted on the two elements, is almost completely concealed therein and thus impossible to manipulate and which can be mounted on and dismounted from the two elements in an extremely simple manner.

This object is achieved by a hinge device which is of the type stated by way of introduction and which according to the present invention is characterised in that the first part and the second part are rigidly connected to each other, the first part has a tubular first housing, whose centre axis defines a first hinge axis and which accommodates two balls, which are located at either end of the housing, an axially displaceable locking member arranged axially inwardly of each ball, a compression spring arranged between and cooperating with each ball and the associated locking member, and an eccentric located between the two locking members and cooperating therewith, and the second part has a tubular second housing, whose centre axis defines a second hinge axis parallel to the first hinge axis and which accommodates two balls, which are located at either end of the housing, an axially displaceable locking member arranged axially inwardly of each ball, a compression spring arranged between and cooperating with each ball and the associated locking member, and an eccentric located between the two locking members and cooperating therewith, each eccentric being rotatably carried about a transverse axis in the respective housing and rotatable between an initial position, in which the two associated locking members are located in an axially inner position and the two associated balls are located in a position projecting slightly from the housing, in which position they are held biased by the respective compression spring, and an active position, in which the two associated locking members are located in an axially outer position, in which they abut against the respective ball axially locking it in the projecting position, and the first part and the second part being intended, when the eccentric is in the initial position, to be inserted in a recess in the first and second elements, respectively, such that the balls thereof engage with mutually opposite depressions in the respective recess, the balls being axially lockable in the respective depression by rotating the eccentric into the active position.

By virtue of the fact that the two parts of the hinge device are not interconnected by a single pivot unit, which would have been positioned between the mutually pivotable elements, but instead have two pivot units (housings with components disposed therein) which, as said two parts are fully inserted in the recess in the respective element, will also be positioned inside the respective element, the hinge device is completely concealed during use and therefore impossible to manipulate. The hinge device is mounted by simply inserting its two parts in the respective recess and securing them in this position by turning the respective eccentric to its active position. The dismounting is equally simple and is realized by turning the respective eccentric to its initial position and subsequently removing the two parts from the recesses.

The first part and the second part are preferably formed in one piece.

In a preferred embodiment, the first part and the second part are formed from a sheet-metal plate, which is bent into a U-shape, the two U-legs being bent over at their free ends for forming the tubular housings.

Preferably, the dimensions of the sheet-metal plate are such that, when the first part is inserted in the recess in the first element and the back of the web portion of the U-shaped sheet-metal plate bears against a side wall of the recess, the balls of the first part engage with the mutually opposite depressions in the recess, and that, when the second part is inserted in the recess in the second element and the back of the web portion of the U-shaped sheet-metal plate bears against a side wall of the recess, the balls of the second part engage with the mutually opposite depressions in the recess.

Furthermore, the dimensions of the sheet-metal plate are preferably such that the length of the U-legs of the sheet-metal plate bent into a U-shape, as measured from the back of said web portion to the centre axis of the respective housing, equals the distance from the centre of the depression in the recess of the corresponding element to the opening of the recess plus the thickness of the sheet-metal plate.

Conveniently, the two U-legs have the same length.

In a preferred embodiment, the hinge device further has two U-shaped brackets, one of which is intended to be inserted and fixed in the recess in the first element and the other of which is intended to be inserted and fixed in the recess in the second element, the legs of each bracket being provided with oppositely arranged holes which, when the bracket is in its inserted and fixed state, define said depressions in the respective recess.

Conveniently, the tubular housings have end portion upsets designed to retain the balls therein.

DESCRIPTION OF A PREFERRED EMBODIMENT

Figure 1:
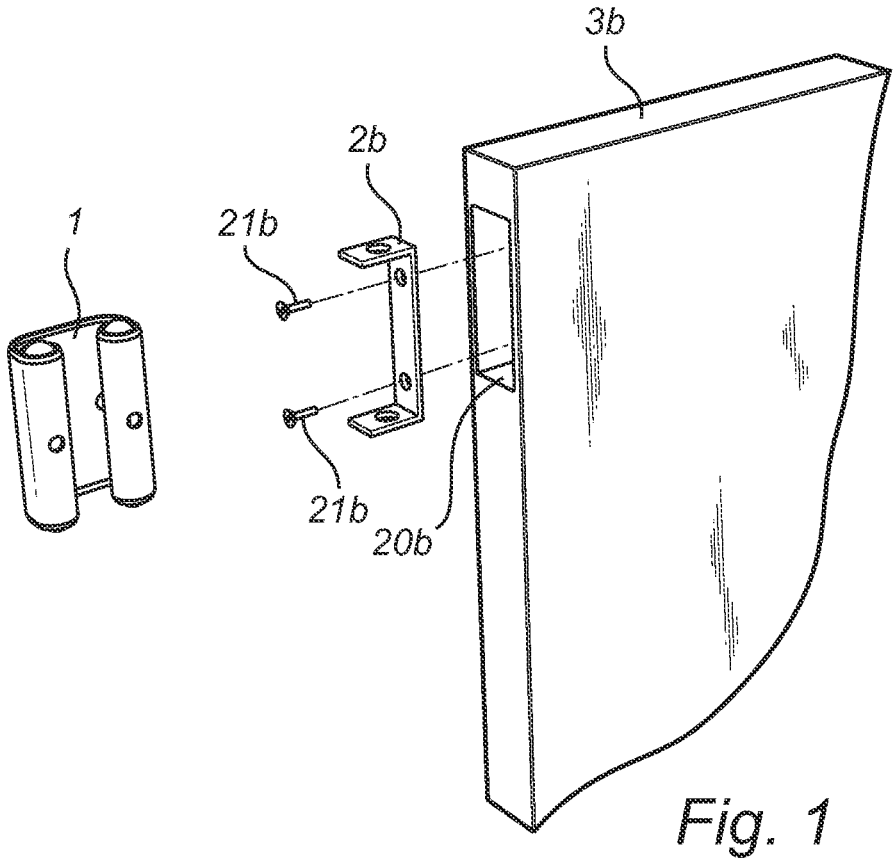
FIG. 1 is a perspective view of a hinge device according to the invention and an upper portion of a pivotable element in the form of a door.
Figure 2:
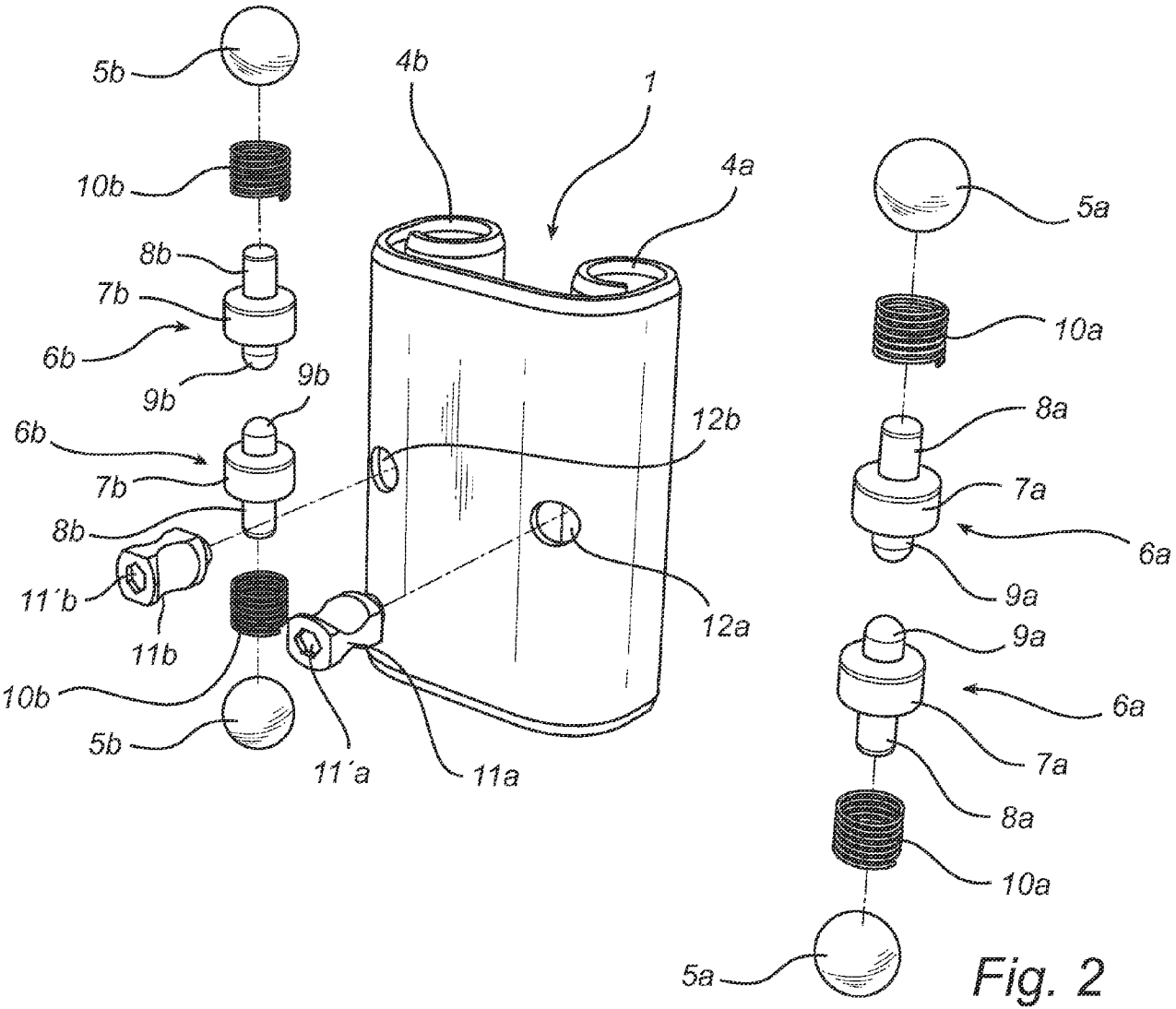
FIG. 2 is an exploded perspective view of a main body and its associated components which form part of the hinge device according to FIG. 1.

The hinge device shown in FIG. 1 comprises a main body 1 and components disposed therein, which will be described in more detail below, as well as two U-shaped brackets 2*a* and 2*b*, only one (2*b*) of which is shown in FIG. 1.

Figure 5:
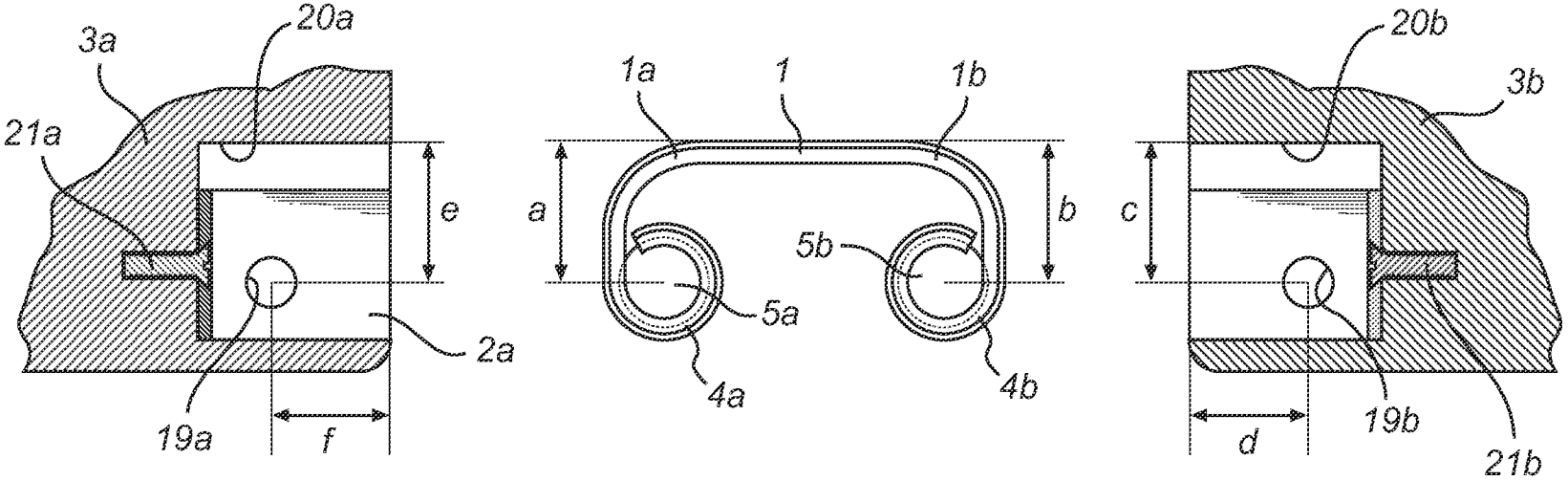
FIG. 5 shows the hinge device according to FIG. 1 when positioned between a door and a door frame, which are shown in horizontal section.
Figure 8:
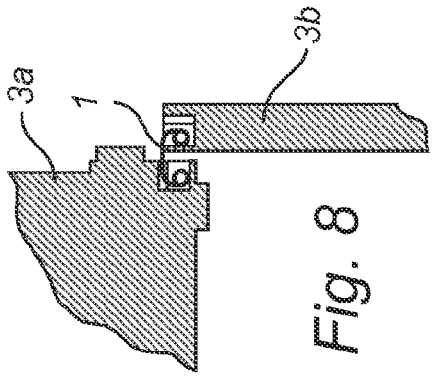
FIGS. 6-10 illustrate the functioning of the hinge device and show the door in different pivoting stages relative to a door frame.

The main body 1 can be divided into a first part 1*a* and a second part 1*b* (FIG. 5). It should be noted, however, that these two parts 1*a* and 1*b* are rigidly connected to each other by being formed in one piece. The first part 1*a* is intended to be attached to a first element 3*a*, which in the shown embodiment is a door frame, whereas the second part 1*b* is intended to be attached to a second element 3*b*, which in the shown embodiment is a door, so as to enable pivoting of the two elements 3*a* and 3*b* relative to each other.

The first part 1*a* and the second part 1*b* are formed from a single sheet-metal plate, which is bent into a U-shape, the two U-legs being bent over at their free ends for forming a respective tubular housing 4*a*, 4*b* having a substantially circular cross section.

The first part 1*a* thus has a tubular first housing 4*a*, whose centre axis defines a first hinge axis. The housing 4*a* accommodates two balls 5*a*, whose diameter substantially corresponds to the inner diameter of the tubular housing 4*a* and which are located at either end of the housing 4*a*.

The housing 4*a* further accommodates an axially displaceable locking member 6*a* arranged axially inwardly of each ball 5*a* and having a circular central portion 7*a*, whose diameter substantially corresponds to the inner diameter of the housing 4*a*, an axially outwardly extending lug 8*a* designed to cooperate with the respective ball 5*a* and an axially inwardly extending lug 9*a* with a rounded end.

A compression spring 10*a* is arranged between each ball 5*a* and the respective locking member 6*a* and abuts at one end against the ball 5*a* and at the other end against the central portion 7*a* of the locking member 6*a*.

Finally, the housing 4*a* accommodates an eccentric 11*a*, which is arranged between the two locking members 6*a* for cooperating therewith. The eccentric 11*a* is rotatable about a transverse axis, which is defined by oppositely arranged holes 12*a*, 13*a* and 14*a* in the web portion of the U-shaped sheet-metal plate and the tube wall of the tubular housing 4*a*. The hole 12*a* in the web portion and the hole 13*a* in the tubular wall closest to the web portion have a larger diameter than the hole 14*a* in the tube wall that is located diametrically opposite the hole 13*a*. The eccentric 11*a* has a substantially cylindrical portion 15*a*, which has the same diameter as the hole 13*a* and which is carried therein, and a lug 16*a* which projects from the other end of the portion 15*a* and which has the same diameter as the hole 14*a* and is carried therein. The eccentric 11*a* has in its cylindrical portion 15*a* a substantially circumferential eccentric groove 17*a* with which the two locking members 6*a* engage by means of the rounded end of the respective lug 9*a* (see FIGS. 3A and 3B). The groove 17*a* has two diametrically opposed deep portions and two diametrically opposed shallow portions.

The first part 1*a* and the second part 1*b* have mirror symmetry with respect to each other. The second part 1*b* thus has a tubular second housing 4*b*, whose centre axis defines a second hinge axis parallel to the first hinge axis. Like the first housing 4*a*, the second housing 4*b* accommodates two balls 5*b*, two locking members 6*b*, two compression springs 10*b* and an eccentric 11*b*. These components 5*b*, 6*b*, 10*b* and 11*b* are designed and arranged in the same manner as the corresponding components 5*a*, 6*a*, 10*a* and 11*a*, respectively, described above and function in the same way. Accordingly, the locking member 6*b* has a circular central portion 7*b* and projecting lugs 8*b* and 9*b*. The eccentric 11*b* has a substantially cylindrical portion 15*b* provided with a substantially circumferential, eccentric groove 17*b*, and a projecting lug 16*b* and is rotatable about a transverse axis, which is defined by oppositely arranged holes 12*b*, 13*b* and 14*b* in the web portion of the U-shaped sheet-metal plate and the tube wall of the tubular housing 4*b*.

Each of the tubular housings 4*a*, 4*b* has end portion upsets designed to retain the balls 5*a*, 5*b* therein.

The function of these components will now be described with reference to FIGS. 3A and 3B, which show the housing 4*a* of the first part 1*a* in longitudinal section. Once more, it should be noted that the components of the second part 1*b* work in the same manner.

Figure 3A:
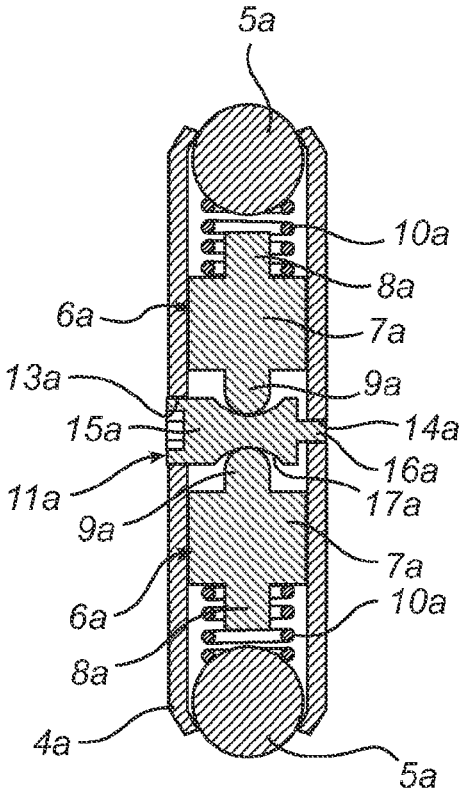
FIGS. 3A and 3B are longitudinal sectional views of a housing which forms part of the main body shown in FIG. 2 in two different positions with respect to the components mounted therein, FIG. 3A illustrating an initial position and FIG. 3B illustrating an active position.
Figure 3B:
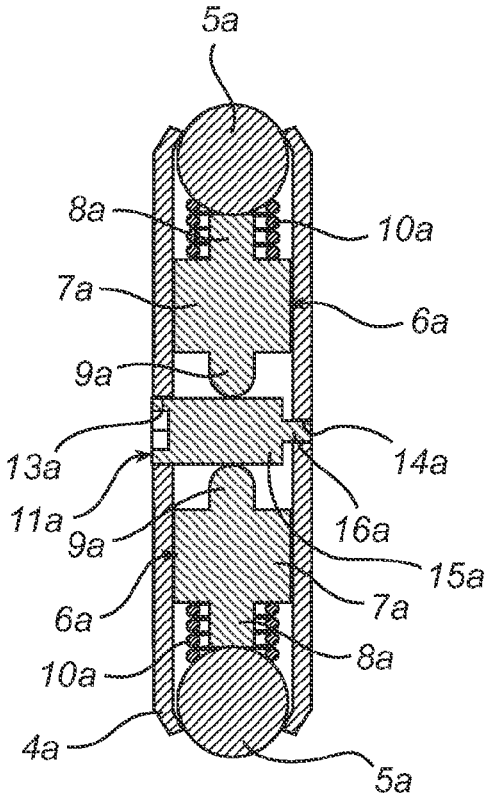

FIG. 3A shows an initial position, in which the rotatable eccentric 11*a* is located in a first position of rotation (initial position), in which the two lugs 9*a* of the locking members engage, by means of their rounded ends, with the diametrically opposed deep portions of the groove 17*a*, the locking members 6*a* being thus in an axially inner position. In the initial position, the compression springs 10*a* moves the respective ball 5*a* into a position slightly projecting from the respective end of the housing 4*a* where it abuts against the respective end portion upset. As the eccentric 11*a* is rotated to the second position of rotation shown in FIG. 3B (the active position), the locking members 6*a* are displaced axially outwards to an axially outer position during compression of the compression springs 10*a*. In the active position, the two lugs 9*a* of the locking members engage, by means of their rounded ends, with the diametrically opposed shallow portions of the groove 17*a*, the ends of the two lugs 8*a* of the locking members abutting against the respective ball 5*a* axially locking it in the projecting position, i.e. preventing it from being pushed in.

The eccentric 11*a* (11*b*) is rotatable by means of a hexagon wrench which, via the hole 12*a* (12*b*) in the web portion of the U-shaped sheet-metal plate, is inserted in a hexagon recess 11'*a* (11'*b*) formed in the end surface of the substantially cylindrical portion 15*a* (15*b*).

Figure 4:
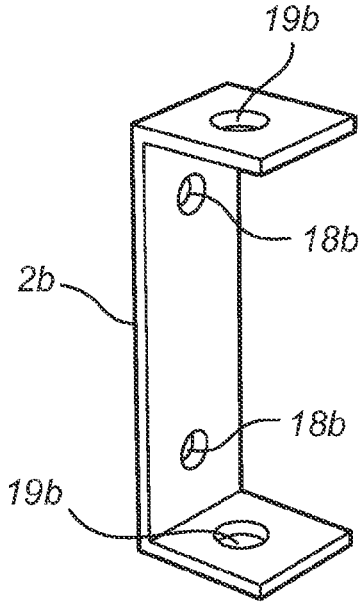
FIG. 4 is a perspective view showing one of two brackets included in the hinge device according to FIG. 1.

The hinge device further comprises, as mentioned above, two brackets 2*a* and 2*b*, which are identical and one 2*b* of which is shown in greater detail in FIG. 4.

The shown bracket 2*b* is U-shaped and has in its web portion two mounting holes 18*b* and in each of its legs a hole 19*b*. The holes 19*b* are intended to cooperate with the two balls 5*b* of the second part 1*b* and to form depressions for receiving said balls. The bracket 2*b* is to be inserted in a recess 20*b* formed in the edge surface of the door 3*b* and to be fixed in said recess by means of screws 21*b* which extend through the mounting holes 18*b*.

The other bracket 2*a* is intended to be inserted in a recess 20*a* formed in the door frame 3*a* and to be fixed therein by means of screws 21*a*, which extend through its mounting holes 18*a*. The leg holes 19*a* of the bracket 2*a* are intended to cooperate with the two balls 5*a* of the first part 1*a* and to form depressions for receiving said balls. The first part 1*a* is intended to be inserted in the recess 20*a* of the door frame 3*a*, or more particularly in the bracket 2*a* positioned therein. Upon insertion of the first part 1*a*, which occurs with the eccentric 11*a* in the initial position, the balls 5*a* are pushed into the housing 4*a* in a spring-biased manner. When the balls 5*a* reach a position opposite the holes 19*a* in the legs of the bracket 2*a*, they are again pushed out by the compression springs 10*a* to the projecting position for engaging with the holes 19*a*. The first part 1*a* is fixed in the recess 20*a* by rotating the eccentric 11*a* to the active position.

The second part 1*b* is intended to be inserted and fixed in the recess 20*b* of the door 3*b* or more particularly in the bracket 2*b* positioned therein in the manner described above with respect to the first part 1*a*.

In the shown embodiment of the hinge device, the U-legs of the first part 1*a* and the second part 1*b* have a length a and b, respectively, as measured from the back side of the web portion to the centre axis of the respective housing 4*a* and 4*b*, that equals the distance e and c, respectively, between the side wall of the respective recess 20*a* and 20*b* which bears against the back side of the web portion and the centre of the holes 19*a* and 19*b*, respectively, of the respective bracket 2*a* and 2*b* inserted and fixed in the respective recess 20*a* and 20*b*. Moreover, the distance f and d, respectively, between the centre of the holes 19*a* and 19*b*, respectively, of the respective bracket 2*a* and 2*b* inserted and fixed in the respective recess 20*a* and 20*b* and the opening of the respective recess equals the length of the leg length a and b, respectively, minus the thickness of the sheet-metal plate. In the shown embodiment, the two U-legs have the same length, i.e. a=b.

Although FIG. 5 shows that brackets 2*a* ad 2*b* have holes 19*a* and 19*b* to define depressions in which the balls 5*a* and 5*b* may engage, it should be understood that a hinge device according to at least one example embodiment may be employed without the use of brackets 2*a* and 2*b* . For example, mutually opposite depressions may be formed in recesses 20*a* and 20*b* such that locations of the depressions within the recesses correspond to the locations of holes 19*a* and 19*b* . Accordingly, the balls 5*a* and 5*b* may engage with the depressions in the recesses 20*a* and 20*b* without the use of brackets 2*a* and 2*b* .

FIGS. 6-10 show the hinge device when positioned on the door frame 3*a* and the door 3*b*, which means that the two brackets 2*a* and 2*b* are inserted and fixed in the respective recess 20*a* and 20*b* and that the first part 1*a* is inserted in the recess 20*a* in the frame 3*a* and the second part 1*b* is inserted in the recess 20*b* in the door 3*b*, the eccentrics 11*a* and 11*b* of the two housings 4*a* and 4*b* being moved by means of rotation to their active position, whereby the balls 5*a* and 5*b* engage in an axially locked manner with the holes 19*a* and 19*b*, respectively in the respective bracket 2*a* and 2*b*.

Figure 7:
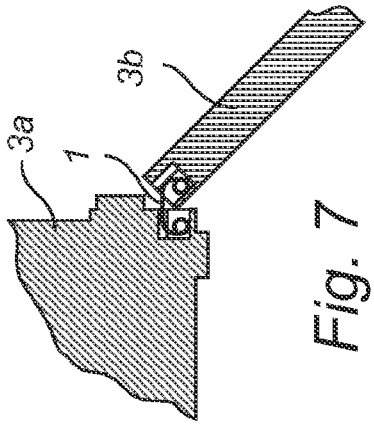
Figure 6:
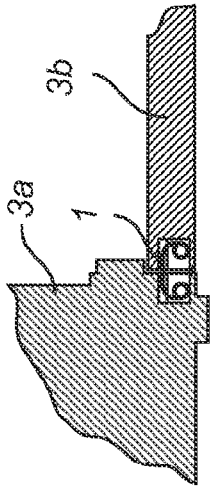
Figure 10:
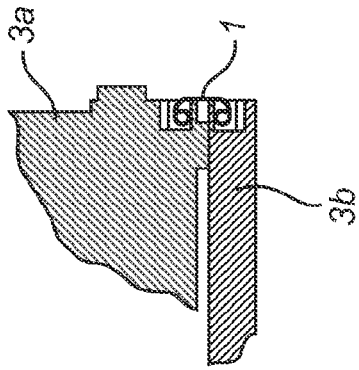
Figure 9:
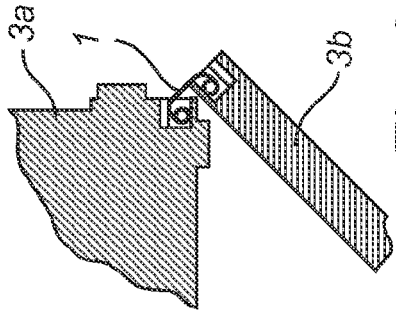

FIG. 6 shows the door 3*b* in an initial position, in which its pivoting angle relative to the frame 3*a* is 0°. When the door 3*b* is pivoted from the initial position, it pivots about the second hinge axis defined by the centre axis of the second housing 4*b*. This is illustrated in FIG. 7 by a pivoting position in which the pivoting angle of the door is 45°. This pivoting about the second hinge axis is continued until the door reaches the pivoting position shown in FIG. 8, in which the pivoting angle is 90°. Upon continued pivoting of the door 3*b* from the 90 degree position, the hinge devices pivots relative to the frame 3*a* about the first hinge axis defined by the centre axis of the first housing 4*a*. This is illustrated in FIG. 9 by a pivoting position in which the pivoting angle of the door is 135°. The door 3*b* can be pivoted further to an end position, which is shown in FIG. 10 and in which its pivoting angle is 180°.

It should be noted that the latter pivoting angle, i.e. the 180 degree end position, is the position in which the main body 1 inserted in the recesses 20*a* and 20*b* is fixed therein by the hexagon wrench mentioned above being inserted, via the holes 12*a* and 12*b* in the web portion, whose back side is fully exposed when the door 3*b* is in the end position (see FIG. 10), in the hexagon recess 11'*a*, 11'*b* of the respective eccentric 11*a*, 11*b* for rotating the eccentric to the active position.

It will be appreciated that the hinge device described above can be modified in various ways within the scope of the claims. Accordingly, the separate locking members 6*a* and 6*b* may, for example, be replaced by a locking member formed integrally in one piece with the respective eccentric 11*a*, 11*b*, which means that the eccentric acts directly on the balls 5*a*, 5*b* and that the springs 10*a*, 10*b* act between the balls and the eccentric.

The invention claimed is:

1. A hinge device mountable on a first element, such as a door frame, and on a second element, such as a door, to enable pivoting of the two elements relative to each other, the hinge device comprising:

a first part, which is attachable to the first element, and a second part, which is attachable to the second element, wherein, the first part and the second part are rigidly connected to each other, the first part includes, a tubular first housing defining a first hinge axis, two balls being located within opposite ends of the first housing, an axially displaceable locking member arranged axially inwardly of each ball, a compression spring arranged between and cooperating with each ball and the associated locking member, and an eccentric located between the two locking members and cooperating therewith, and the second part includes, a tubular second housing defining a second hinge axis parallel to the first hinge axis, two balls being located within opposite ends of the second housing, an axially displaceable locking member arranged axially inwardly of each ball, a compression spring arranged between and cooperating with each ball and the associated locking member, and an eccentric located between the two locking members and cooperating therewith, each eccentric is rotatable about an axis transverse to the first hinge axis and the second hinge axis, each eccentric being rotatable between an initial position and an active position, the initial position being a position in which the two associated locking members are located in an axially inner position so that the springs project at least part of the balls beyond the housing the active position being a position in which the two associated locking members are located in an axially outer position so that the locking members abut against the balls and project at least part of the balls beyond the housing, and when the eccentric is in the initial position, the balls are retractable into the housing, and when the eccentric is in the active position, the balls are not retractable into the housing.

2. A hinge device according to claim 1, wherein the first part and the second part are formed in one piece.

3. A hinge device according to claim 2, wherein the one piece is a sheet-metal plate having a web portion and two ends, the two ends being bent over to form the tubular housings.

4. A hinge device according to claim 3, wherein the dimensions of the sheet-metal plate are such that, when the first part is attached to the first element, the balls of the first part engage with the first element, and that, when the second part is attached to the second element, the balls of the second part engage with the second element.

5. A hinge device according to claim 4, wherein the dimensions of the sheet-metal plate are such that the first hinge axis and the second hinge axis are a same distance from a back of the web portion.

6. A hinge device according to claim 3, wherein the two ends have the same length.

7. A hinge assembly, comprising:

the hinge device of claim 1; and two U-shaped brackets, one of which insertable and fixable on the first element and the other of which is insertable and fixable on the second element, legs of each bracket being provided with oppositely arranged holes which, when the bracket is in an inserted and fixed state, define depressions in the respective recess.

8. A hinge device according to claim 1, wherein the tubular housings have end portion upsets designed to retain the balls therein.

9. A hinge device mountable on a first element and on a second element to enable pivoting of the two elements relative to each other, the hinge device comprising:

a first part, and a second part, the first part and the second part being rigidly connected to each other and formed in one piece, the one piece having two ends and a web portion, the two ends being bent over to form the first part and the second part such that the first part and the second part are separated by the web portion, wherein, the first part includes, a tubular first housing, defining a first hinge axis, two balls being located within opposite ends of the first housing, two compression elements arranged between and cooperating with the two balls, and an eccentric located between the two compression elements, the second part includes, a tubular second housing defining a second hinge axis parallel to the first hinge axis, two balls being located within opposite ends of the second housing, two compression elements arranged between and cooperating with the two balls, and an eccentric located between the two compression elements, each eccentric being rotatable about a transverse axis in a respective housing between an initial position and an active position, and the web portion is offset from the first hinge axis and the second hinge axis.

10. The hinge device of claim 9, wherein each of the first and second tubular housings includes an axially displaceable locking member arranged axially inwardly of each ball on opposite sides of the eccentric.

11. The hinge device of claim 10, wherein the initial position is a position in which the two associated locking members are located in an axially inner position so that the springs project at least part of the balls beyond the housing, and the active position is a position in which the two associated locking members are located in an axially outer position so that the locking members abut against the balls and project at least part of the balls beyond the housing.

12. The hinge device of claim 10, wherein the eccentric has diametrically opposed deep portions and diametrically opposed shallow portions.

13. The hinge device of claim 12, wherein the locking members engage with the diametrically opposed deep portions if the eccentric is in the initial position, and the locking members engage with the diametrically opposed shallow portions if the eccentric is in the active position.

* * * * *